US006754917B1

(12) United States Patent
Rhoades

(10) Patent No.: US 6,754,917 B1
(45) Date of Patent: Jun. 29, 2004

(54) POWERED AUXILIARY TOILET SEAT LIFT

(76) Inventor: Delbert R. Rhoades, P.O. Box 2530, Post Falls, ID (US) 83877

( * ) Notice: Subject to any disclaimer, the term of this patent is extended or adjusted under 35 U.S.C. 154(b) by 0 days.

(21) Appl. No.: 10/368,865

(22) Filed: Feb. 19, 2003

Related U.S. Application Data

(60) Provisional application No. 60/359,240, filed on Feb. 19, 2002.

(51) Int. Cl.[7] ..... A47K 13/10
(52) U.S. Cl. ..... 4/667
(58) Field of Search ..... 4/667

(56) References Cited

U.S. PATENT DOCUMENTS 4,168,552 A * 9/1979 Austin ..... 4/667
5,063,617 A * 11/1991 Ward et al. ..... 4/667
5,737,780 A * 4/1998 Okita et al. ..... 4/667
6,470,513 B1 * 10/2002 Cook ..... 4/667

* cited by examiner

*Primary Examiner*—Robert M. Fetsuga
(74) *Attorney, Agent, or Firm*—Keith S. Bergman

(57) ABSTRACT

A powered auxiliary toilet seat lift provides a U-shaped casement formed by two similar elongate side members interconnected by a forward end plate to fit about a toilet stool and support a toilet seat structure thereabove for vertical and forwardly and downwardly angulated motion. Each casement side member is peripherally defined to create an internal chamber carrying similar elongately spaced lateral pairs of forward and rearward compound jackscrews that pivotally interconnect with the toilet seat structure thereabove. Powering mechanism provides separate electric motors powering each jackscrew that are controlled by a computerized feedback type circuitry for manually selectable or pre-programed motion of the toilet seat structure.

9 Claims, 5 Drawing Sheets

POWERED AUXILIARY TOILET SEAT LIFT

This appl. claims benefit of Ser. No. 60/359,240 filed on Feb. 19, 2002.

BACKGROUND OF INVENTION

1. Field of the Invention

My invention relates generally to water closets or toilets and more particularly to an ancillary structure positionable about a toilet stool that provides an auxiliary toilet seat powered for vertical and tilting motion.

2. Background and Description of Prior Art

Water flushed toilets have become an almost universally present fixture in modern bathrooms in the Western world, and through their history has been long and their development has become sophisticated, the common water flushed toilets of the present day can present substantial problems of use by infirm or disabled persons who may have substantial problems in entering on, using and exiting from the toilet fixtures. These problems have been recognized and various solutions heretofore proposed. Most of those solutions however have not had much universality, but rather have been directed toward use with particular toilet fixtures or toward solving particular problems of use of the fixtures by persons having particular infirmities or disabilities. None of such prior fixtures have had sufficient universality to service a substantial number of the various toilet devices available in the present day market place nor do they solve use problems with all or a substantial number of persons having differing disabilities or infirmities. The instant powered toilet seat seeks to solve or alleviate various of these unsolved toilet use problems of the infirm and disabled.

An ordinary chair type seat of commerce usually has a height of approximately 15 to 16 inches above a supporting surface, though the seat of modern toilets commonly has a height of approximately 13 to 14 inches above an underlying supportive surface and the tendency of change in height of modern toilet seats, if any, seems to be downward, probably to tend to decrease toilet cost and increase functional utility for persons not having disabilities or infirmities. These standards however, insofar as disabled or infirm persons are concerned, tend to make modern toilets even less accessible and useful than were various of their older counterparts.

Past efforts to make standard commercial toilets more accessible and useful for the infirm and disabled have generally centered about a first class of devices that provide supports adjacent a toilet stool that can be manually grasp by a user to aid ingress and egress from the toilet stool and a second class of devices that provide an auxiliary seating surface spacedly above the normal toilet stool seat to support the disabled or infirm user at a higher position which is easier to enter and exit from. The instant invention provides a device of the second class that has a powered seat structure providing both vertical and forwardly tilting seat motion.

Auxiliary supports of the first class have long been known and probably presently are the most common type of devices used to aid infirm and disabled persons in using toilet fixtures. The supports however, are not universally useable. If the supports constitute an unattached movable structure, such as a walker, the device is not necessarily positionally stable to safely support the toilet user and if the support is fixedly positioned on some secondary stable support such as a wall, floor supporting the toilet, or the toilet itself, the supports tend to disrupt the functional utility of both the bathroom and toilet fixture therein for both able and disabled users. Such secondary support structures usually required, or at least need, for safety and security the presence of a second person in the bathroom chamber to aid and secure a disabled or infirmed person in using the toilet. This somewhat limits the support's utility because of the required presence of a second person and the social mores that have developed in Western cultures concerning the privacy of toilet functions.

Probably the most common of the second class of toilet aids for the disabled and infirm, that provides a support spacedly above the ordinary toilet stool seat, has been a simple tubular extension or "collar" that merely rests on an existing toilet seat to support a user spacedly thereabove. A common modern day embodiment of this collar comprises a tubular cylinder of usually 4 to 8 inch height and approximately 12 to 14 inch external diameter that rests, and is entirely supported on the upper surface of the ordinary toilet seat. Though these collars are of simple and economic construction, they may not be positionally stable, as they are positionally maintained only by reason of friction between adjacent surfaces of the extension collar and the supporting toilet seat. A user may easily and accidentally move the collar partially or completely from the toilet seat to possibly cause the user to fall therefrom. Such collars for safety may be associated with some type of external support for positional maintenance, but such association generally tends to lessen potential benefits of both of the associated devices. It is particularly difficult and hazardous for a person aided by crutches or a wheelchair to use an unsupported extension collar on a toilet seat.

Various heretofore known chair and stool-like seating devices that have generally provided vertically movable seating elements have moved downwardly either responsive to a user's weight to store kinetic energy in a biasing element such as a spring to aid user egress or responsive to inertial forces generated by an entering or seated user to serve as a shock absorber. These seating devices generally provide some type of a medial support structure for the seat element, and by reason of this have not generally been associated with toilets as auxiliary seating structures because the medial supports would interfere with or disrupt the toilet function. Though some such seating devices have provided angulated motion of the seat structure to aid a user entering and exiting the seats and have been moved by a user's weight, or stored kinetic energy initially generated by the user's weight, they generally have not powered such motions such as by a user controllable electric motor or otherwise.

In the recent past, it has become known to provide a seat structure for a toilet stool that is powered for vertical motion, such as described by Okita, et al., in U.S. Pat. No. 5,737,780. This seat lifting device however, provides no powered seat tilting motion and in general would require the use of some auxiliary support structure of the first class invalid toilet support devices or a human assistant to make the device safely usable, especially by more severely disabled or infirm users.

The instant powered toilet seat lift differs from this prior art in providing a stand alone device with a U-shaped casement that fits about many, if not most, existing toilet stools and with seat structure adjustably powered for both vertical and tilting motion relative to the casement. The seat structure is moved by four quadrentially positioned jackscrews, each separately powered by an electric motor communicating through a gear drive to provide screw motion of appropriate speed for the safe powered motion of the seat element. The motors are operated by electric control apparatus that provides either user selectable or preprogrammed motion. The four jackscrews are of a compound nature to provide a strong and reliable mechanical support for the seat structure in all positions, while yet providing forward tilting motion in a vertical plane, especially to aid a user in entering and exiting the seat.

The toilet seat lift is self-contained and independent of a toilet fixture with which it is used. The seat lift may be removed from about an associated toilet fixture if it is not desired for continuous use or it may be attached to the underlying floor for semipermanent but yet removable positioning if desired. It also may be used in association with the toilet fixture in either fixed or non-fixed mode by non-disabled users, especially in its lowered position which makes the use of the toilet fixture substantially the same as if the seat lift were not present. The use of the auxiliary seat structure requires no modification of the toilet fixture with which it is to be used and requires no modification of the structural elements of the toilet closure or area in which the associated toilet fixture is located.

My toilet seat lift provides a casement that is large enough, heavy enough, and so configured as to provide positional stability on an underlying supportative surface without mechanical attachment to that surface. The casement also provides an upper surface that is of greater area and lateral extent than an ordinary toilet seat to not only support the auxiliary toilet seat but also to allow casement support of two upstanding grasping bars inwardly adjacent each side of the seat and a rearward upstanding support behind the seat to provide a substantially greater support function than do ordinary prior auxiliary toilet seat structure.

All of these different structures and functions distinguish my powered auxiliary toilet seat from previously known devices of the same class. My invention resides however, not in anyone of these features individually, but rather in the synergistic combination of all of its structures which necessarily give rise to the functions flowing therefrom.

SUMMARY OF INVENTION

My powered toilet seat lift provides a peripherally defined U-shaped casement, having two similar sides each defining internal chambers and interconnected by a forward end, to fit about the side and front portions of a toilet stool. The internal chambers of the sides each carry two elongately spaced powering mechanisms, each having a motor operatively communicating through a transmission with a compound jackscrew carried for controlled vertical motion above the upper edges of the side chambers. At least the rearward laterally opposed pair of jackscrews are pivotally mounted on the casement bottom to allow motion somewhat angulated to the vertical. The four compound jackscrews support a toilet seat structure above the upper surface of the casement for vertical motion and pivotal motion in an elongate vertical plane. The toilet seat structure defines a medial orifice vertically above the upper orifice of a toilet stool about which the toilet seat lift is to be used and carries an auxiliary toilet seat on its upper surface about the periphery of the orifice. A pair of opposed upstanding hand rails are carried by the toilet seat structure inwardly adjacent each side and laterally of the auxiliary toilet seat and an upstanding U-shaped support is carried rearwardly of the auxiliary toilet seat to aid user support.

Control apparatus carried in the casement side chambers regulates operation of the powering mechanisms that move the four jackscrews. The control apparatus regulates the direction and amount of rotation of each powering mechanism motor to provide angulated and vertical motion of the toilet seat structure responsive to either direct user control or selectable preprogrammed control instructions. The powering motors are of a direct current stepping type to allow accurate-control for required syncronation. The control apparatus has motor motion and jackscrew position sensors to allow feedback type control of toilet seat structure motion and positioning.

In providing such a device, it is:

A principal object to provide a powered auxiliary toilet seat lift having a U-shaped casement to fit about toilet stools of various manufacturers that carries a toilet seat structure thereabove for vertical and angulated motion over a serviced toilet stool.

A further object is to provide such a toilet seat lift wherein the toilet seat structure is moved by four quadrantally arrayed jackscrews, at least the laterally paired rearward two of which are pivotally mounted to allow both vertical and forwardly angulated motion of the toilet seat structure.

A further object is to provide such jackscrews that are of a compound telescoping nature with screws and nuts of the same pitch in all compound elements to allow similar extension of the jackscrews upon similar rotation, notwithstanding which compound element rotates.

A further object is to provide such a toilet seat lift wherein the compound jackscrews are individually powered by similar electric stepping motors operating through geared transmissions and controlled by computer based feedback type controls to allow accurate manual or selective preprogrammed operation of both the vertical and tilting motions of the toilet seat structure.

A still further object is to provide such a toilet seat structure having a base of larger size than the traditional toilet seat carried thereby to allow provision of upstanding opposed lateral support bars on each side of the toilet seat base and a rearward upstanding support bar to aid safe usage of the lift by disabled persons without second party aid.

A still further object is to provide such a toilet seat lift that is powered by low voltage direct current to provide greater safety of use in the event of accidental electrical happenings in the lift itself or from the general toilet environment.

A still further object is to provide such a toilet seat lift that is of new and novel design, of rugged and durable nature, of simple and economic manufacture and one otherwise well suited to the uses and purposes for which the device is intended.

Other and further objects of my invention will appear from the following specification and accompanying drawings which form a part hereof. In carrying out the objects of my invention however, it is to be understood that its essential features are susceptible of change in design and structural arrangement with only one preferred and practical embodiment being specified and illustrated as is required, but this is not intended to be limiting.

BRIEF DESCRIPTION OF DRAWINGS

In the accompanying drawings, which form a part hereof and in which like numbers of reference refer to similar parts throughout.

DESCRIPTION OF PREFERRED EMBODIMENT

Figures 1, 2:
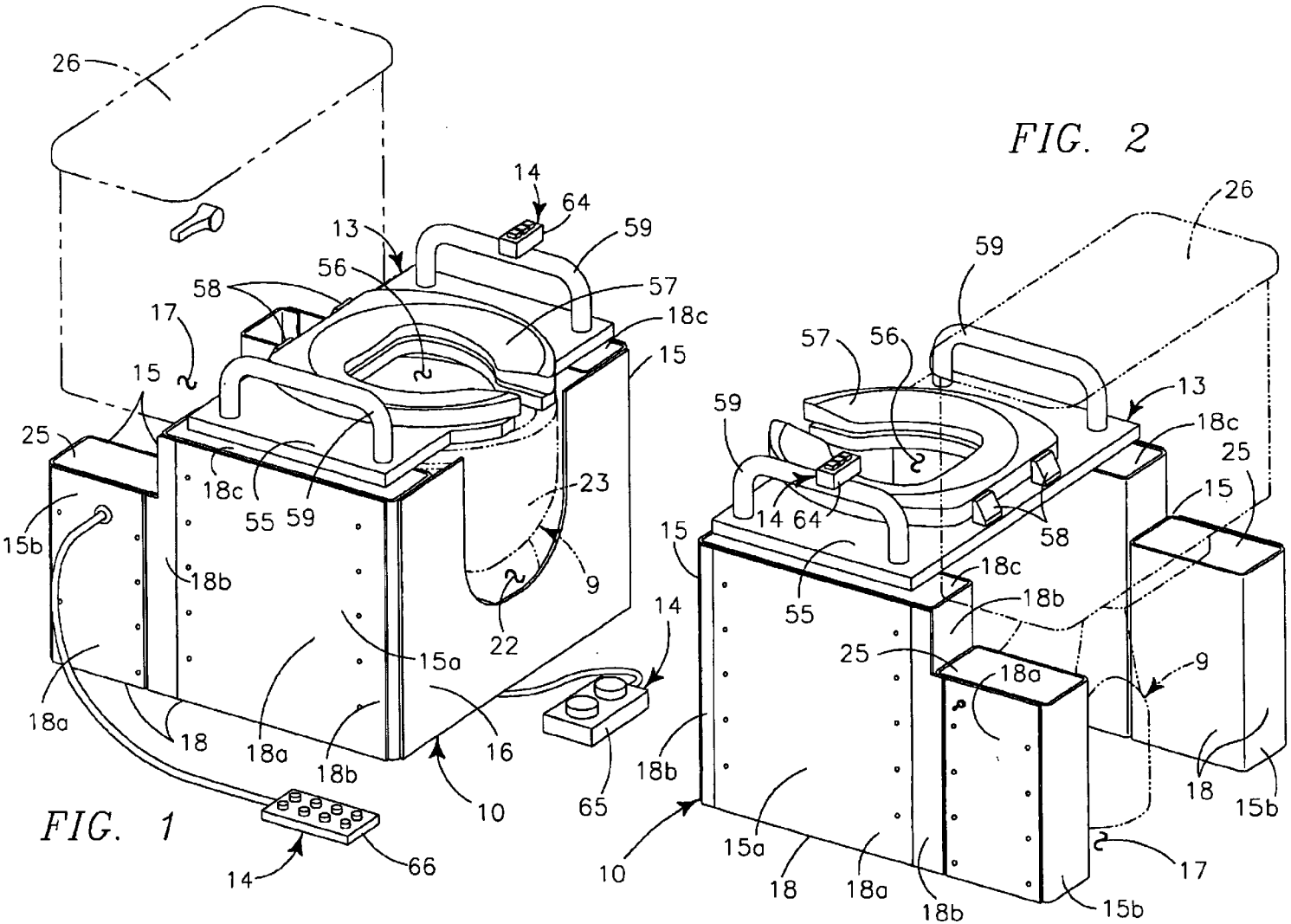
FIG. 1 is a laterally rearward looking isometric view of my toilet seat lift in operative position about an ordinary toilet stool, illustrated in phantom outline, to show various of the lift parts, their configuration and relationship.
FIG. 2 is a laterally forward looking isometric view of the toilet seat lift of FIG. 1 showing various parts, their configuration and relationship from this aspect.

My invention generally provides casement 10 carrying quadrentially arrayed jackscrews 11 extending thereabove that are powered by powering mechanisms 12 controlled by computerized control apparatus 14 to move toilet seat structure 13 vertically and angularly in an elongate vertical plane.

Casement 10 is a U-shaped structure formed by two similar side members 15, that are mirror images of each other joined at their forward ends by forward end plate 16 to create a U-shaped structure defining medial void 17 of such configuration and size as to fit about at least one or various of the toilet stools of present day commerce, with which my lift is to be used.

Each side member 15 has sufficient width in the lateral direction that, when peripherally formed by relatively thin peripheral elements 18, it defines enclosed internal chambers 19. The forward outer side peripheral panels 18*a* are releasably joined to the side elements 18*b* to allow access to internal chamber 19*a*. The other surface elements 18 are structurally joined at their adjacent edges and surfaces with any necessary supportative elements or framework to create side members 15 of appropriate structural strength and rigidity. Commonly, though not necessarily, peripheral elements 18 will be formed of sheet metal, preferably stainless steel, by ordinary known manufacturing methods common in the sheet metal manufacturing art.

In the instance illustrated the side members 15 are formed with an areally larger and higher forward portion 15*a* and an areally smaller and lower rearward portion 15*b*, collectively defining internal chamber 19 so that the smaller chamber portion 19*b* may carry control apparatus and larger chamber portion 19*a* may carry jackscrews 11 and their powering mechanism 12. Top panel 18*c* of forward side portion 15*a* defines forward vertical hole 20 to allow passage of forward jackscrew 11*a* and rearward elongate slot 21 to allow passage of the rearward jackscrew 11*b*, for limited pivotal motion in an elongate direction.

Forward end plate 16 is a planer element preferably of the same height as the forward portions 15*a* of the side members 15 and is structurally joined to the forward surface of each side member. The upper medial portion of forward end plate 16 defines U-shaped slot 22 extending a spaced distance downwardly from the upper edge of the forward end plate 16. This slot 22 is dimensioned and configured to allow the upper forwardly protruding portion 23 of toilet stool 9 to fit therein so that the casement 10 may be positioned further rearwardly relative to the toilet stool 9 to insure that an auxiliary toilet seat carried by the toilet seat structure 13 will be substantially vertically above the orifice defined by the toilet stool 9.

Casement 10 of the toilet seat lift is configured and dimensioned so that one, or preferably more, of the toilet stool 9 of the present day market place will fit within medial void 17 when the casement 10 is placed from a forward position about a toilet stool 9 to be serviced with the toilet seat carried by toilet seat structure 13 positioned substantially vertically above the upper orifice of toilet stool 9.

The lower top surfaces 25 of smaller rearward portions 15*b* of side members 15 are particularly useful in my lift if the lift is used with toilets that have an external water closet 26 projecting outwardly from a supporting wall structure spacedly behind toilet stool 9, as seen in FIGS. 1 and 2. The lower height of the rearward side portions 15*b* of the casement 10 will allow those portions to pass beneath the lower surface of water closet 26 to allow the desired positioning of the casement 10 relative to the toilet stool 9 without requiring unnecessary casement length. Configurationally the lower surface of casement 10 should be substantially co-planer to fit with substantial surface contact on a floor surrounding a toilet stool to be serviced. The upper surface of casement 10 should be at a height approximately the same as the upper surface of a toilet stool to be serviced to allow the lower surface of toilet seat structure 13 of my toilet seat lift, when in lowered relaxed position, to be positioned immediately above the toilet stool 9 when its normally attached seat is removed.

Figure 3:
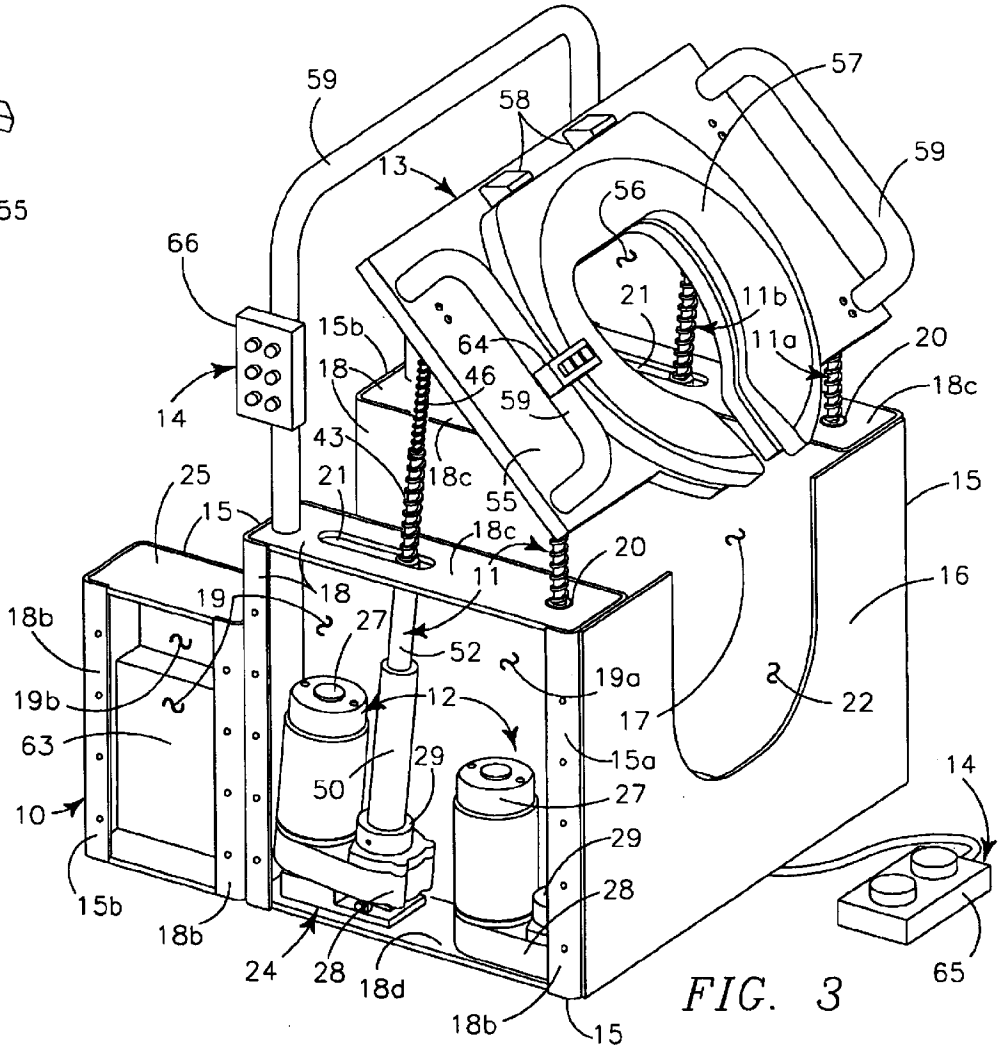
FIG. 3 is an isometric view of the toilet seat lift of FIG. 1 with the toilet seat structure in a raised and angulated position and the right side motor chamber cover removed to show the powering mechanism and jackscrews.

Powering mechanisms 12 are carried in larger chambers 19*a* defined in a forward side portions 15*a* of each side member 15 as seen in FIG. 3. The powering mechanism in each side member provides two electric motors 27 each having integral geared transmissions carried in base 28 to drive upstanding output shafts 29 at appropriate rotary speed. The powering mechanisms 12 are heretofore known per se, available in the present day market place, and therefore not described in unnecessary detail.

Figure 5:
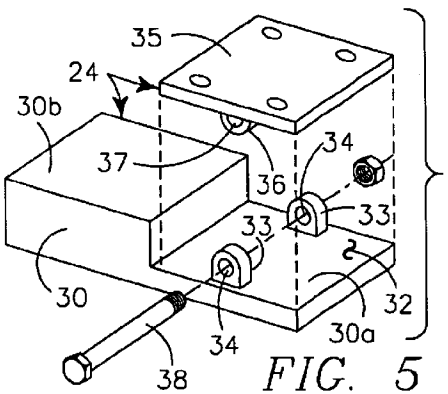
FIG. 5 is an enlarged expanded isometric view of the pivotal mounting structure for the powering mechanism of the laterally opposed rearward jackscrews of FIG. 3.

As seen particularly in FIGS. 3 and 5 base elements 28 of each electric, motor 27 are pivotally carried by motor mounts 24 structurally supported on bottom 18*d* of casement 10 that partially defines chamber 19*a* in the larger forward portion 15*a* of each side member 15. Each motor mount body 30 is a rectilinear structure defining indentation 32 in its upper forward portion 30*a* with laterally opposed upstanding fastening ears 33, each defining medial axially aligned pivot rod hole 34 in its medial portion. Pivotal motor mount 35 fits in indentation 32 and defines two laterally opposed depending fastening ears 36, each defining holes 37 to align with holes 34 to receive pivot pin 38 therethrough to pivotally mount the motor mount 35 relative to mount body 30. Preferably the rearward upper surface 30*b* of motor mount body 30 is substantially coplaner with the upper surface of pivotal mount portion 35 when the two elements are assembled for pivotal motion. The laterally paired rearward motors 27 in each chamber 19*a* of forward portion 15*a* of each side member 15 must have a pivotal motor mount 24 as described to allow pivotal motion of an associated jackscrew to cause forward and downward pivotal motion of the toilet seat structure 13 as hereinafter described in detail. The two laterally paired forward motor mount structures in each chamber 19*b* may have this same type of pivotal mounting structure if desired, though it is not necessary as the two laterally opposed forward jackscrews do not require pivotal motion to serve their purposes in vertically moving the forward portion of toilet seat structure 13.

Jackscrews 11 are of a compound nature to allow the members to be substantially contained within internal chamber 19*a* of the forward portion 15*b* of each side member 15 when in relaxed mode, while yet allowing the jackscrews to extend substantially thereabove to provide the desired motion of toilet seat structure 13. All four jackscrews 11 of my lift are similar.

Figure 6:
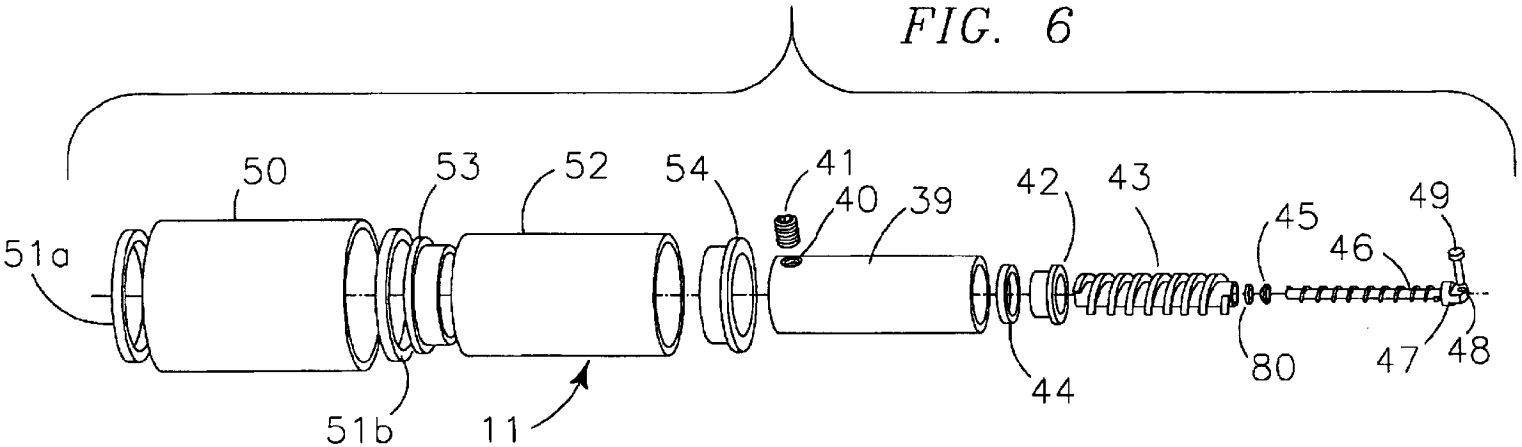
FIG. 6 is an expanded isometric view of a jackscrew to show its internal structure.

As seen in FIG. 6 each jackscrew provides lowermost tubular housing 39 irrotatably carried by output shaft 29 of the powering mechanism by reason of set screw 41 extending therebetween the lowermost tubular housing 39 irrotatably carries internally threaded nut 42 in its upper end portion. Tubular externally threaded screw tube 43 is threadedly engaged in internally threaded nut 42 to extend therebelow where screw tube 43 immovably carries threadedly engaged lock type stop nut 44 in its lower end portion to prevent the lower end portion from moving upwardly through nut 42 responsive to rotation of tubular housing 39.

The upper end portion of externally threaded screw tube 43 irrotatably carries press fit internally threaded inner screw shaft nut 45 which in turn threadedly carries elongate externally threaded inner screw shaft 46. The inner screw shaft 46 carries lock type stop nut 80 below inner screw shaft nut 45 to prevent the inner screw shaft from passing upwardly above the screw shaft nut 45. The uppermost portion of the inner screw shaft 46 carries fastening lug 47 defining hole 48 to receive nut-bolt fastener 49 therethrough to releasably attach the toilet seat structure 13 to the upper portion of each jackscrew 11.

Most, if not all, types of threads are operative with my jackscrews but, I prefer Acme or similar type threads for all threaded elements because of their force transmitting characteristics, structural integrity and lack of maintenance.

The pitch of threads in all threaded elements preferably should be the same. If the threads defined in these elements do not have the same pitch, the upward motion of the jackscrews may not be the same which would cause skewed motion of the toilet seat structure 13 when moved and in extreme cases might cause sufficient skewing of the laterally opposed jackscrews to make them or their powering mechanisms inoperative.

The jackscrew structure per se as described and seen in FIG. 6, preferably but not necessarily, is covered by a compound telescoping cover for safety, sanitation and aesthetic purposes. This telescoping cover provides lower cover tube 50 carrying lower internal guide bushing 51*a* and upper internal guide bushing 51*b* to maintain outer tubular housing 52 in axial alignment therein. The lower cover tube 50 carries telescoping upper cover tube 52 with lower guide bushing 53 in its lower end portion and upper guide bushing 54 in its upper end portion. The upper guide bushing 54 is moved upwardly by the screw shaft nut 45 so as to extend the cover tube coextensively with the extension of the screw shaft nut.

Toilet seat structure 13 as seen in FIGS. 1–3 provides planar rigid base 55 with a periphery similar to and substantially coextensive with the tops of side element portions 15*a* of casement 10 and the area therebetween. Base 55 defines medial ovoid orifice 56 configurationally substantially similar to the orifice defined by toilet stool 9 when the base is positioned vertically thereabove. Auxiliary toilet seat 57 of conventional configuration is mounted by laterally spaced hinges 58 on the rearward medial part of base 55. The auxiliary toilet seat 57 is configured and dimensioned to fit over and about the periphery of orifice 56 defined in base 55. Each lateral side portion of base 55 carries U-shaped support bars 59 to aid a user in entering and exiting from the toilet seat structure and in positional maintenance when seated thereon.

Figure 4:
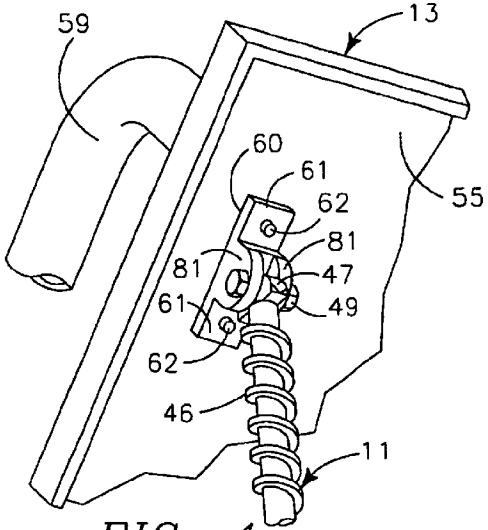
FIG. 4 is an enlarged partial upward looking isometric view of the pivotal interconnection of a jackscrew with the toilet seat support structure.

As seen in FIG. 4 the under surface of base 55 carries four depending quadrentially arrayed jackscrew support bracket 60, each spaced to be vertically above one of the jackscrews 11 to pivotally receive the upper end portion of the associated jackscrew when the jackscrews are in a vertical mode in their lowermost position. Each support bracket 60 has elongately extending fastening tabs 61 defining holes to receive fasteners 62 to interconnect the brackets 60 with base 55 thereabove. The medial portion of each bracket 60 provides laterally spaced depending fastening ears 81 to receive fastening lug 47 of the associated jackscrew 11 therebetween and pivotally maintain the lug by nut-bolt type fastener 49 extending through holes in each ear and hole 48 in fastening lug 47. This connecting structure of support brackets 60 and associated jackscrews 11 allows pivotal motion of the toilet seat structure 13 in an elongately extending vertical plane as seen in FIG. 3.

Figure 7:
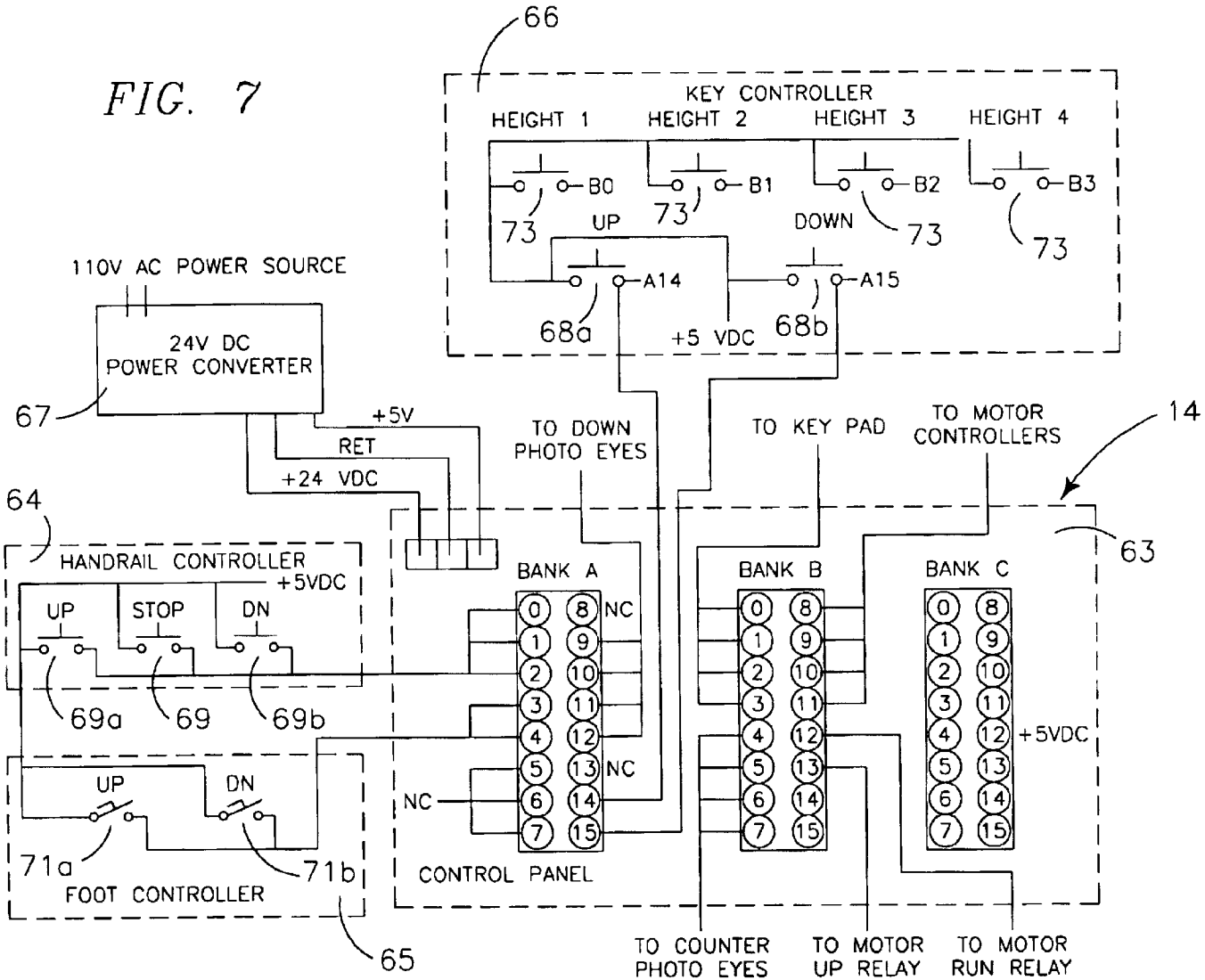
FIG. 7 is a generic diagram in normal electrical symbology of the circuitry of the control panel for the toilet seat lift.

Control apparatus 14 uses a simple computer type processor to control the motion of toilet seat structure 13. A generic form of circuitry that has been found suitable for such purpose is illustrated in FIGS. 7–10 in normal electrical symbology. Control panel 63 and manual hand rail controller 64, foot controller 65, and key pad controller 66 are illustrated in FIG. 7. The control apparatus 14 is provided with 110 volt alternating current power from an available power supply and passes the alternating current through power converter 67 where it is translated into twenty-four volt and five volt direct current for powering the motors and the control apparatus, respectively. The control panel 63 carries three banks of control and memory chip sets designated as Bank A, Bank B and Bank C that interconnect the three externally associated wire connected user controllers 64, 65, 66.

Hand rail controller 64 is preferably carried on the horizontal portion of one lateral support bar 59 of the toilet seat structure 13, normally on the side of major dexterity of the particular user, and preferably is positionally maintained by releaseable fastening bands to allow portability and positional change. The hand rail controller 64 carries three push button switches 69, 69*a* and 69*b* to permit up or down motion of jackscrews 11 or to stop the motion of those jackscrews after motion has been initiated.

Foot controller 65 is positionable on a floor supporting the toilet seat lift adjacent casement 10. The foot controller 65 provides two foot operated switches 71*a*, 71*b*, biased to an off position, to institute and continue up or down motion of jackscrews 11 responsive to pressure upon the foot pads.

Key pad controller 66 provides push button switches 68*a*, 68*b* to regulate up and down motion of jackscrews 11 and further provides four program switches 73, which upon closure institute pre-programed motion sequences which raise jackscrews 11 to a pre-determined heights to determine downward and forwardly sloping angulation of the toilet seat structure to accommodate persons of particular body configurations.

Figure 9:
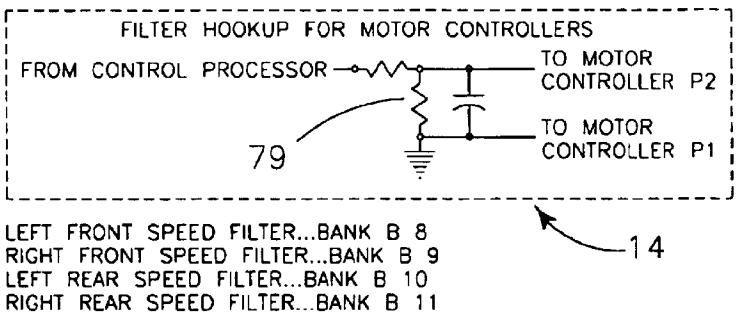
FIG. 9 is a diagram of the local circuitry connecting motor controllers and the control panel.
Figure 8:
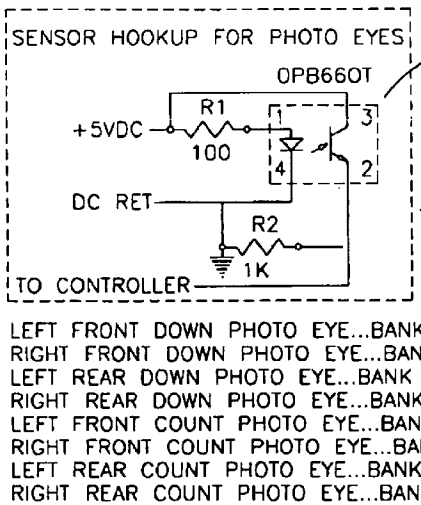
FIG. 8 is a diagram of the local circuitry connecting counting and position sensing electric eyes and the control panel.
Figure 10:
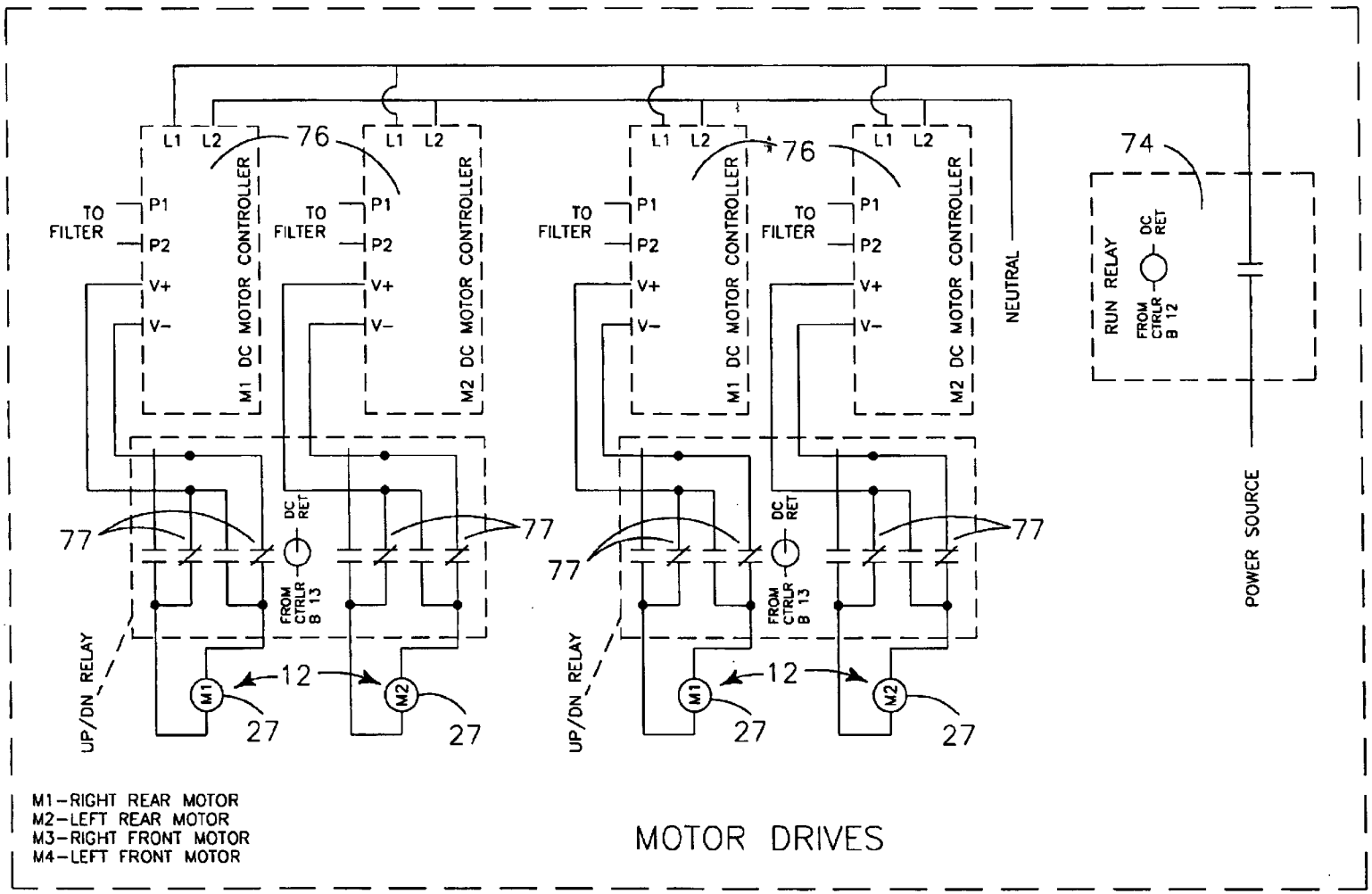
FIG. 10 is a diagram of the local circuitry connecting the motor drives with the control panel.

The motor drive circuitry illustrated in FIG. 10 provides run relay 74 to pass twenty-four volt DC current to two pairs of similar motor controllers 76, associated respectively with each lateral pairs of electric motors 27, responsive to control signals received from control panel 63. The current output of motor controller 76 for each laterally opposed pair of jackscrews passes through up/down relays 77 to determine direction of motion of the serviced laterally opposed pair of motors 27. Each motor controller 76 is serviced by a pair of photo eyes 78 seen in FIG. 8 to limit the maximum up and down motion of the associated jackscrew for safety and reset purposes. Typical circuitry linking the photo eyes 78 is shown in FIG. 8. Each motor controller 76 has filter circuitry 79 to tie a control processor to the associated motor controller. A typical circuit 79 interconnecting the control processor with the motor controllers 76 is shown in FIG. 9.

The foregoing control and powering circuitry is not new and novel per se but rather is within the skill and knowledge of persons in the electronic motor control arts and therefore is not described in detail as its only purpose in my toilet seat lift is as a necessary element to make the combination of lift elements operative.

Operatively after an up switch 69*a*, 71*a* or 68*a* of hand rail controller 64, foot controller 65 or key pad controller 66 respectively is closed, motor direction, run and modulated DC power circuits are turned on and stay on until the rear lateral pair of jackscrews are up to their maximum height. After a fixed period of time from operation of an up switch, preferably one half second, the direction, run and modulated DC power circuits are activated and all four motors 27 are energized to move the associated jackscrews in an upward direction. Once the toilet seat structure 13 of the lift starts up, the activating up button can be released and the lift will continue its up motion until it reaches the full up position or the down button is activated. After a down switch 69*b*, 71*b* or 68*b* of the hand rail, foot or key pad controllers is closed, the direction, run and modulated DC circuits are turned on and stay on until all four jackscrews 11 are all down in their lowermost null position. At a predetermined time, preferably one half second, after the direction run and modulated DC circuits are activated both rear and front lateral pairs of motors 27 are energized in the downward direction. When each jackscrews 11 reaches its full down position the motors are all turned off.

The lift may be equally well operated to its up and down modes by any of the three controllers 64, 65, 66. The computerized controller of the system may be programed to automatically reset the system to a null position if desired. Each motor output shaft has a control sensor which counts revolutions of the motor to determine position of each jack shaft at any particular functional state.

The power supply for the motors can be varied as desired in a particular unit, but preferably for safety it is between 90 volts DC which requires approximately a one ampere drive per motor and 24 volts DC which requires approximately a four to five ampere drive per motor.

The push button switches 73 of key pad 66 allow various motion sequences for the up and down switches 68, 69, 71 to be preprogramed to provide motion that accommodates the physical attributes and particular desires of various users. This is especially useful for persons of differing heights by programing the maximum height to which the toilet seat structure 13 is lifted and the amount of angulation that it assumes at that maximum height.

To use my device a toilet seat lift is constructed according to the foregoing specification. The toilet stool with which the toilet seat lift is to be used preferably but not necessarily has its seat structure removed and the seat lift is placed about the toilet stool with the orifice 56 substantially vertically above the toilet stool upper orifice. The seat lift may be temporarily or permanently fastened in this position with fasteners extending between the bottom or lower portion of casement 10 and an underlying floor, or by use of brackets and fasteners (not shown) interconnecting the lower surface of side elements 15 with the underlying floor. The lift also may be used without physical interconnection with the supporting surface about a serviced toilet stool by reason of the substantial surface area that is supported on the underlying floor which creates sufficient friction for positional maintenance that is only increased when the lift is supporting a user.

With the lift in this position a potential user may activate one of the program push buttons 73, if it be desired to use a particular pre-programed setting and upon operating an up switch 68*a*, 69*a* or 71*a* the lift will extend upward to its highest pre-programed position. The user may activate only one of the up switches 69*a*, 71*a* or 68*a* and powering mechanism 12 will activate the control apparatus to operate jackscrews 11 to move the toilet seat structure 13 upwardly as shown in FIG. 3, with the two rearward laterally paired jackscrews moving to an elevation higher than the two laterally paired forward jackscrews to cause the toilet seat structure 13 to angulate forwardly and downwardly as illustrated.

The user then does any normal undressing required for use of the toilet seat lift and positions himself or herself facing forwardly immediately forwardly adjacent of the auxiliary toilet seat 57. The user then moves rearwardly, and downwardly if necessary, to position his buttocks on the auxiliary toilet seat 57 so that he or she is partially supported thereon while still partially standing on his or her feet. The user then activates one of the down switch buttons 68*b*, 69*b*, or 71*b* or which responsively activates downward motion of powering mechanism 12 to move all four jackscrews downwardly to their lowermost null position, responsive to preprogramed instructions carried in the memory chips of the control processor. This motion of the toilet seat structure brings that structure into a horizontal use position either resting on or immediately above the upper surface of the forward side portion 15*a* of casement 10.

When use of the toilet is completed by the user, the up button of one of the controllers 64, 65, 66 is operated to close the associated up switch and the cycle immediately before described is repeated to raise the toilet seat structure 13, with the user partially or completely supported thereon, to its uppermost position whereat the user will be supported substantially on his feet and in a position for simple and easy exit from the lift by reversing the process by which the lift was entered. The toilet seat structure 13 then may be left in the upward position to be ready for its next use or if desired it may be lowered to its horizontal null position on or immediately above casement 10 by activating one of the down switch buttons 69*b*, 71*b* or 68*b* carried by each controller.

It is to be noted that the up and down switches of each of the three controllers 64, 65, 66 serve the same purpose and any one controller is sufficient for the of the lift, though the three different controllers illustrated may make that operation easier and more simple. The foot switch is particularly useful if the lift is to be operated by an attendant who is to aid or assist a user of the lift. If multiple selectable preprogramed lift motion instructions are to be used with my lift, a controller such as the key pad 66 is used to provide multiple selection switches 73 for the selection of each particular pre-programed function, which may be activated by an up or down switch of any controller.

The foregoing description of my invention is necessarily of a detailed nature so that a specific embodiment of it might be set forth as is required, but it is to be understood that various modifications of detail, rearrangement and multiplication of parts might be resorted to without departing from its spirit, essence or scope.

Having thusly described my invention, what I desire to protect by Letters Patent, and

What I claim is:

1. A powered auxiliary toilet seat lift that fits about the sides and front of a toilet stool having an upper orifice for vertical motion of an auxiliary toilet seat to aid ingress and egress of disabled and infirm persons on the auxiliary toilet seat for use of the toilet stool, comprising in combination:

a U-shaped casement having similar side elements interconnected by a forward end plate to extending rearwardly the forward end plate to define a medial void to fit about the vertical surface of the toilet stool, said casement having coplanar vertical height substantially the same as the height of the toilet stool and the side elements being peripherally defined to enclose similar internal side chambers;

a laterally opposed first pair of compound jackscrews pivotally carried in the rearward portion of the internal side chamber of each side element and a laterally opposed second pair of compound jackscrews carried in the forward portion of the internal side chamber of each side element, all said jack screws being extendable spacedly above the upper portion of the casement;

powering mechanism associated with each jackscrew carried in the internal side chambers of the side elements, each said powering mechanism including an electrically powered motor driving the associated jackscrew through a transmission for rotary motion of the jackscrew to move the upper portion of each jackscrew vertically;

toilet seat structure having a rigid planar base substantially co-extensive with the upper portion of the casement, said base pivotally supported on the upper portions of the laterally opposed pairs of jackscrews for limited vertical motion above the casement responsive to jackscrew motion, defining a medial orifice, geometrically, similar to the shape of the upper orifice of the toilet stool and defined vertically above the upper orifice of the toilet stool when the casement is positioned about sides and front of the toilet stool, and an auxiliary toilet seat pivotally carried for motion in a vertical plane to rest on the upper surface of the base and be pivoted in an upward and rearward direction therefrom;

control apparatus to determine vertical and tilting motion of the toilet seat structure relative to the casement having at least one controller with at least two switches to start and stop jackscrew motion to determine up and down vertical motion of the toilet seat structure between a lower use position immediately above the upper portion of the casement and an upper entry and exit position spacedly above the casement.

2. The auxiliary toilet seat structure of claim 1 wherein the at least one controller regulates up and down motion of the laterally opposed first pair of rearward jackscrews independently of the up and down motion of the laterally opposed second pair of forward jackscrews.

3. The auxiliary toilet seat lift of claim 1 wherein the side elements of the casement extend rearwardly spacedly beyond the rearward extension of the toilet seat structure base and carry a U-shaped laterally extending upstanding user support and each lateral side portion of the base of the toilet seat structure laterally of the auxiliary toilet seat carries a U-shaped elongately extending upstanding user support to aid user motion and positional stability on the toilet seat lift.

4. The auxiliary toilet seat lift of claim 1 further characterized by the forward end plate defining a slot in its upper medial portion to fit about a forwardly extending protuberance of a toilet stool to allow the toilet seat lift to be positioned further rearwardly relative to the toilet seat than it could be positioned without the slot.

5. The auxiliary toilet seat lift of claim 4 further characterized by the laterally opposed pair of rearward compound jackscrews being pivotally mounted in each internal side chamber for pivotal motion in an elongate vertical plane to allow the rearward portion of the toilet seat structure to be raised above the forward portion for tilting the toilet seat structure in a downwardly and forwardly angling orientation to aid user ingress on and egress from the auxiliary toilet seat.

6. The auxiliary toilet seat lift of claim 1 further characterized by the four compound jackscrews being carried in the casement in quadrate array at vertical position spacedly inwardly adjacent the periphery of the base of the toilet seat structure.

7. The auxiliary toilet seat lift of claim 1 further characterized by the control apparatus comprising a computer having software to control jackscrew motion through feedback type circuitry, and a plurality of electric eye sensors to sense uppermost and lowermost positions of each opposed pair of jackscrews and to sense jackscrew position by determining rotary motion of the motor driving each jackscrew.

8. The auxiliary toilet seat lift of claim 7 further characterized by the control apparatus having a first hand rail controller mounted on one of the U-shaped supports carried by the toilet seat structure and having three push button switches with a first button to institute up motion, a second button to institute down motion and a third button to stop either motion of the jackscrews;

a second foot controller having two foot pad switches to institute and continue up motion and down motion respectively responsive to depressing motion of the foot pads only during the depressing motion of the jackscrews; and a third key pad controller having first and second buttons to institute continuing up motion and down motion respectively of the jackscrews and a plurality of buttons to select pre-programmed motion sequences instructions that determine without further user input the vertical motion of each laterally opposed pair of jackscrews to determine the height and angulation of the raised toilet seat structure.

9. The auxiliary toilet seat lift of claim 7 wherein the electric eye sensors of position of the upper portions of the paired laterally opposed rearward jackscrews are spacedly higher than the electric eye sensors of position of the upper portions of the paired laterally opposed forward jackscrews to cause the toilet seat structure to cease its upward motion in a downwardly and forwardly angulated position, when not otherwise preprogrammed, to allow more easy ingress to and exit from the raised toilet seat structure by a user.

* * * * *